United States Patent [19]

Dehan

[11] 4,252,312

[45] Feb. 24, 1981

[54] GYMNASTIC APPARATUS FOR EXECUTING SIMULATED SKIING MOVEMENTS

[75] Inventor: Charles J. M. Dehan, Montpellier, France

[73] Assignee: Establissement Ariabel, Vaduz, Liechtenstein

[21] Appl. No.: 941,748

[22] Filed: Sep. 12, 1978

[30] Foreign Application Priority Data

Sep. 15, 1977 [FR] France ..... 77 27909

[51] Int. Cl.[3] ..... A63B 69/18

[52] U.S. Cl. ..... 272/97; 272/146

[58] Field of Search ..... 272/146, 132, 97

[56] References Cited

U.S. PATENT DOCUMENTS

| | | | |
|---|---|---|---|
| 478,166 | 7/1892 | Madsen | 272/146 |
| 1,565,484 | 12/1925 | McWhirter | 272/146 |
| 2,455,274 | 11/1948 | Scriver | 272/97 |
| 3,021,137 | 2/1962 | Palmer | 272/97 |
| 3,807,727 | 6/1978 | Kaempfen | 272/97 |

FOREIGN PATENT DOCUMENTS

| | | | |
|---|---|---|---|
| 227571 | 10/1910 | Fed. Rep. of Germany | 272/146 |
| 984944 | 3/1965 | United Kingdom | 272/146 |

*Primary Examiner*—Richard J. Johnson

*Attorney, Agent, or Firm*—Neuman, Williams, Anderson & Olson

[57] ABSTRACT

Indoor gymnastic apparatus allowing the user to execute skiing movements including a base upon which a movable plate is mounted by means of a connecting mechanism.

The connecting mechanism includes a ball bearing to permit the plate to rotate in the horizontal plane and a height adjusting mechanism enabling the plate to rock back and forth.

2 Claims, 4 Drawing Figures

GYMNASTIC APPARATUS FOR EXECUTING SIMULATED SKIING MOVEMENTS

This invention involves an indoor gymnastic apparatus allowing the user to execute skiing movements, including a base upon which a movable plate is mounted by means of a connecting mechanism. It is well known that more and more people are skiing every day, leading to many accidents during the first few days of skiing, due to a lack of training.

It has consequently been deemed necessary to develop an apparatus offering this type of special training indoors.

Currently available apparatus of this type permit clockwise and counter-clockwise rotating movements in a single horizontal plane.

Although these apparatus are fairly satisfactory overall, they do not permit accurate simulation of movements made by the body, and pelvic and leg joints, during a downhill run of skis.

Indeed, these apparatus are simply not designed to take the slope of a hill into consideration.

Now, everyone knows that it is much more difficult to keep one's balance on a slope than on the flat.

The main purpose of this invention is to correct this drawback and develop a gymnastic apparatus allowing the user to execute skiing movements which will also offer a rocking motion in addition to rotation in the horizontal plane.

In order to do this, the object of this invention is a gymnastic apparatus of the type mentioned above which is essentially characterized by the fact that its connecting mechanism includes a ball bearing allowing the plate to rotate in the horizontal plane, and a height adjusting mechanism allowing the plate to rock back and forth.

It is readily conceivable that thanks to this arrangement, the plate may be adjusted to the desired height offering a greater or lesser rocking motion which is always accompanied by horizontal rotation.

In a preferred design of this invention, the height adjusting mechanism includes a central part made up of a spherical part and a cylindrical part fastened to the former, with said cylindrical part's being mounted by means of screws in an aperture provided for this purpose in the base.

The advantage of said height adjusting mechanism is that it is made up of a tapped part lying on the floor which may be screwed to a greater or lesser extent into a corresponding threaded part secured to the lower face of a metallic plate acting as a base.

One possible design of this invention is described hereinafter as an example and a reference for the appended drawings of which:

Figure 1:
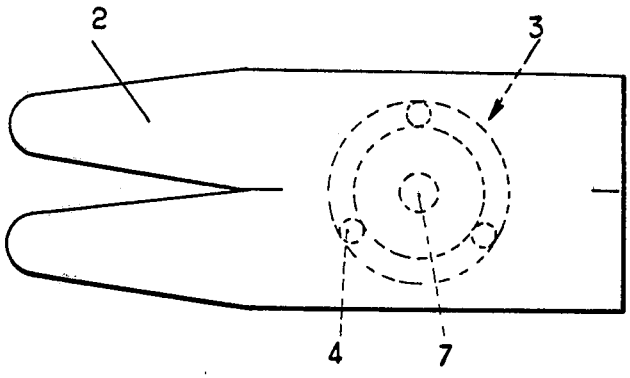
FIG. 1 is a plan view of an apparatus as per the invention.

The gymnastic apparatus represented on the figures begins with a base (1) upon which a movable plate (2) is mounted by means of a connecting mechanism designated in its entirety by (3).

Plate (2) is made up of two plates side by side in the form of very short skis.

Connecting mechanism (3) includes a ball bearing made up of three balls (4) held in a ring (5).

Connecting mechanism (3) includes a part (6) made up of a spherical part (7) and a cylindrical part (8) fastened to the former. The cylindrical part (8) of part (6) is fitted around the rim with threading fitting corresponding threading in an aperture (9) provided in base (1).

It should be noted that a metallic plate (10) is fitted to the top surface of the base (1) by a suitable method, whereas a metallic plate (11) is secured to the bottom face of plate (2). Base (1) is connected to plate (2) by means of a rivet-pin (12) secured to the spherical part (7) of part (6) by means of a washer (13) through an aperture (14) provided in the metallic plate (11). A lock nut (17) is also provided on the threaded portion of part (6) so as to prevent inopportune loosening of the latter while the apparatus is in use.

The apparatus so designed operates in the following manner:

The user steps onto plate (2) with knees slightly bent in a semi-crouched position and begins to twist his torso and legs from right to left imitating the movements made by a skier.

Figure 2:
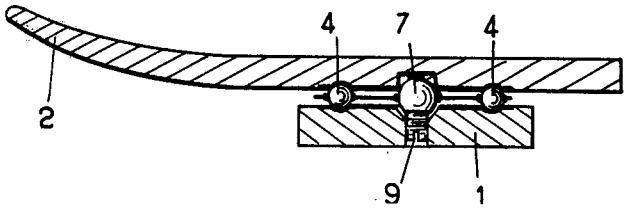
FIG. 2 is a vertical cross-section of the apparatus appearing in FIG. 1.

Part (6) may be in a position similar to that shown in FIG. 2 in which it is at the same level as bearings (4) in the vertical plane. In this case, plate (2) turns in the horizontal plane only, resting on all of the bearings (4) and on part (6).

In order to recreate slope conditions, one need only screw part (6) into aperture (9) in such a way as to raise it so that its spherical portion (7) is above the balls (4) in the vertical plane.

Figure 3:
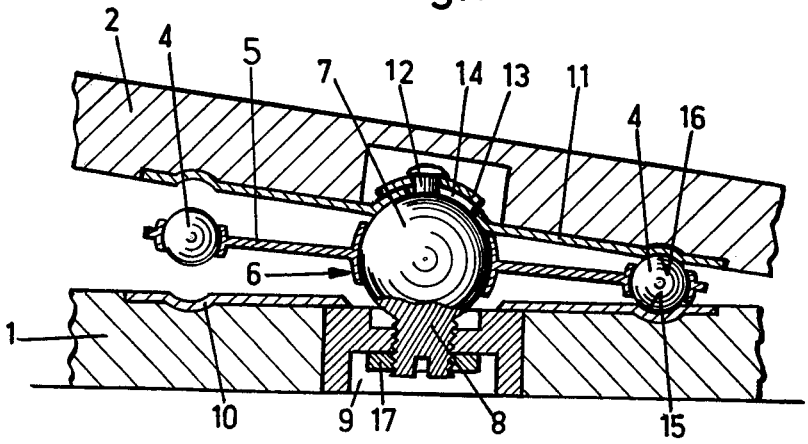
FIG. 3 is a blow-up of part of FIG. 2.

In response to movement imparted to it by the user, plate (2) rests on the central part (6) and upon two of the three bearings (4), adding a rocking motion to the rotating motion of the plate (FIG. 3).

The result is that ankles get better training for turning in all directions and the body and legs follow the exact same movements as those made when skiing down a hill.

Of course, the rocking motion of plate (2) may be increased or decreased by adjusting the height of the central part (6).

Figure 4:
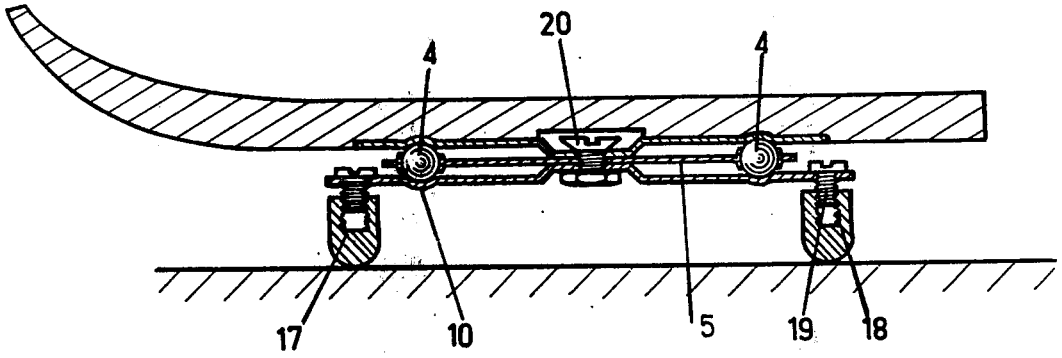
FIG. 4 is a variant of an apparatus as per the invention.

In the example shown in FIG. 4, the height adjusting mechanism is made up of three tapped parts (18) lying on the floor and the base is made up of a metallic plate (10) with three threaded parts (19) fastened to its bottom face operating in conjunction with parts (18).

The base is secured to the plate in this example by means of a rivet (20).

Operation of the apparatus so designed is analagous to that of the preceding apparatus.

It should nevertheless be noted that plate (2) always rests on all bearings (4) both when it turns in the horizontal plane and when it is inclined away from the horizontal.

Indeed, in order to recreate slope conditions, one need only loosen parts (18) to a greater or lesser extent, thus freeing parts (19) which results in placing plate (10) in a tilted position, with the relationship between plate (2) and the latter always remaining the same.

I claim:

1. Gymnastic apparatus allowing a user to execute skiing movements comprising: a base; plate means for receiving the feet of said user and including a semi-spherical socket; connecting means for movably connecting said plate means to said base; said connecting means including a ball bearing which engages said socket to permit movement of said plate means about said ball bearing; said movement being limited by said base; height adjusting means for adjusting the height of said plate means relative to said base to allow said plate means to rock in any direction about said ball bearing wherein the rocking motion possible is increased by increasing the height of said plate means above said base; bearing means rotatably connected to said ball bearing for providing a bearing engagement between said plate means and said base when said bearing means is engaged therebetween by said rocking motion of said plate means; said height adjusting means comprising a threaded cylindrical portion fastened to said ball bearing with said cylindrical portion mounted by means of mating threads in an aperture provided in said base; said bearing means comprising an arcuately formed first collar for receiving said ball bearing and a plate attached to and extending outwardly from said first collar; said plate including three or more individual bearings equally spaced radially from the center of said first collar and equally spaced from one another.

2. Gymnastic apparatus allowing a user to execute skiing movements comprising: a base; plate means for receiving the feet of said user and including a semi-spherical socket; connecting means for movably connecting said plate means to said base; said connecting means including a ball bearing which engages said socket to permit movement of said plate means about said ball bearing; said movement being limited by said base; height adjusting means for adjusting the height of said plate means relative to said base to allow said plate means to rock in any direction about said ball bearing wherein the rocking motion possible is increased by increasing the height of said plate means above said base; bearing means rotatably connected to said ball bearing for providing a bearing engagement between said plate means and said base when said bearing means is engaged therebetween by said rocking motion of said plate means; said height adjusting means comprising a threaded cylindrical portion fastened to said ball bearing with said cylindrical portion mounted by means of mating threads in an aperture provided in said base; said bearing means comprising an arcuately formed first collar for receiving said ball bearing and a plate attached to and extending outwardly from said first collar; said plate including three or more individual bearings equally spaced radially from the center of said first collar and equally spaced from one another; said individual bearings each comprising an arcuately formed collar and a ball bearing mounted therein.

* * * * *